US005129800A

United States Patent [19]

Boblitt

[11] Patent Number: 5,129,800

[45] Date of Patent: Jul. 14, 1992

[54] SINGLE SCREW INTERRUPTED THREAD POSITIVE DISPLACEMENT MECHANISM

[75] Inventor: Wayne W. Boblitt, Pasadena, Md.

[73] Assignee: The United States of America as represented by the Secretary of the Navy, Washington, D.C.

[21] Appl. No.: 731,233

[22] Filed: Jul. 17, 1991

[51] Int. Cl.[5] ..... F04C 18/12

[52] U.S. Cl. ..... 418/112; 418/195

[58] Field of Search ..... 418/195, 112, 136, 104

[56] References Cited

U.S. PATENT DOCUMENTS

| | | | |
|---|---|---|---|
| 3,945,778 | 3/1976 | Zimmern | 418/195 |
| 4,227,867 | 10/1980 | Whitehill et al. | 418/195 |
| 4,492,542 | 1/1985 | Zimmern | 418/195 |
| 4,704,069 | 11/1987 | Kocher et al. | 418/195 |

*Primary Examiner*—Richard A. Bertsch
*Assistant Examiner*—David L. Cavanaugh
*Attorney, Agent, or Firm*—Luther A. Marsh; Howard Kaiser

[57] ABSTRACT

A single screw positive displacement compressor mechanism employing shallow gate rotor tooth penetration of the main rotor for purposes of reducing internal leakage and consequent compressor inefficiencies. The invention is provided with an interrupted main rotor thread for purposes of insuring multiple gate rotor teeth meshing with the drive portion of the main rotor thread, thereby reducing gate rotor tooth flank loads in the compressor section of the device. Provision is also made for main rotor thread baffling between the main rotor chamber section and the mechanism inlet.

9 Claims, 4 Drawing Sheets

SINGLE SCREW INTERRUPTED THREAD POSITIVE DISPLACEMENT MECHANISM

ORIGIN OF THE INVENTION

The invention described herein was made in the performance of official duties by an employee of the Department of the Navy and may be manufactured, used and licensed by or for the Government of the United States of America for governmental purposes without payment of any royalties thereon or therefor.

BACKGROUND OF THE INVENTION

The present invention relates generay to a single screw positive displacement mechanism capable of maintaining a proper mesh between its main rotor and mating gate rotor when there are few gate rotor teeth engaged in the main rotor and further providing for main rotor thread baffling between the main rotor chamber section and mechanism inlet. The invention also provides for the reduction of contact forces between chamber gate rotor sealing flanks thereby reducing gate rotor tooth wear.

Recent developments in shipboard operations require an efficient high-pressure compressor. Devices having a compressed air flow of approximately 3,000 psi are desirable. One device generally suitable for shipboard operations is a positive displacement type machine known as a single screw mechanism. Single screw mechanisms can be made to operate as a compressor, an expansion machine, a pump, a hydraulic motor, or the like.

The primary components of a single screw mechanism are a main rotor, a gate rotor, with or without gate rotor support, and a main rotor housing. Main rotors are typically provided with at least one thread and are driven and rotate about a central axis. The gate rotor, having at least one tooth in meshing engagement with the main rotor thread, is typically driven by the main motor. Often times the gate rotor is backed by a metal gate rotor support, which follows and supports each gate rotor tooth in the main rotor thread for purposes of reducing gate rotor tooth deflection due to operating loads. The main rotor housing is fitted in close proximity to the main rotor and to the crests of the main rotor teeth and is provided with at least one port leading to a suction, or inlet, plenum, and at least one additional port leading to a discharge plenum.

The general operation of a single screw mechanism is as follows: Gas is drawn into the main rotor thread from the suction plenum. When the thread is filled with gas, a gate rotor tooth rotates into position and, in cooperation with the main rotor casing, closes the thread to form a compression chamber. As the main rotor turns, the gate rotor tooth proceeds through the main rotor thread, reducing the compression chamber volume, and thereby compressing the gas. When the desired gas pressure is achieved, the edge of the rotating main rotor thread uncovers a discharge port in the main rotor casing and the compressed gas is expelled into the discharge plenum.

Often times high-pressure single screw compressors have internal leakage that reduces both the volumetric and isentropic efficiencies of the device. In order to reduce the internal leakage and thereby increase the compressor efficiency, it may be necessary to reduce tooth penetration into the main rotor. Reducing the tooth penetration reduces the gate rotor tooth flank lengths and thus the tooth flank leakages. One problem with reducing the gate rotor tooth penetration is that the number of ate rotor teeth engaged in the main rotor is reduced, resulting in timing and meshing problems between the main rotor and gate rotor. Additionally, high-pressure single-screw compressors can experience rapid gate rotor tooth flank wear on critical sealing surfaces on account of the heavy contact forces which exist between the gate rotor and main rotor at high operating pressures. This causes the gate rotor teeth flanks to wear resulting in less effective sealing against internal leakage. Volumetric and isentropic efficiencies for the machine suffer as internal leakage increases.

One way to reduce internal leakage is to baffle main rotor thread crests. More specifically, baffling is accomplished by sealing main rotor threads from the suction side of the device by placing additional main rotor thread crests or casing crests between the compression chamber portion of the mechanism and the mechanism inlet. These additional thread or casing crests reduce thread leakage and thereby improve the mechanism's efficiency.

As can be seen from the above discussion, from the standpoint of mechanism efficiency, it is desirable to reduce gate rotor tooth penetration into the main rotor in order to have less tooth flank leakage, which is essential for efficient high-pressure devices. It is also desirable to have a gate rotor configuration which resists wear in order to provide for reliable high-pressure operation, and it is further necessary at high pressures to baffle main rotor threads to reduce leakage and improve efficiency. Accordingly, for these and other reasons, the need exists for a device to insure the proper meshing of slightly penetrating gate rotor teeth with baffled main rotor threads while reducing gate rotor tooth wear at critical sealing surfaces.

SUMMARY OF THE INVENTION

It is therefore an object of the present invention to develop an efficient high-pressure positive displacement mechanism.

It is another object of the present invention to provide for proper timing and meshing between gate rotor teeth and main rotor threads in a device having shallow gate rotor tooth penetration into the main rotor.

It is another object of the present invention to provide main rotor thread baffling in a single screw mechanism in order to improve efficiency.

Yet another object of the present invention is to provide for gate rotor teeth which resist wear in order to minimize leakage and promote the efficiency of the mechanism.

According to one embodiment of the present invention, the foregoing and other objects are obtained by providing a positive displacement single screw mechanism having a single main rotor with a plurality of interrupted threads. Said interrupted threads are divided into two groups or sections axially separated by a portion of the main rotor which contain no threads. Both sections of said threads at all times simultaneously engage one or more gate rotor teeth circumferentially disposed around a circular, planar gate rotor. One portion of said plurality of interrupted threads serves in connection with the shallow penetration of at least one Sate rotor tooth and the casing of the device to form a compression chamber. The remaining section of the main rotor teeth serves only to drivingly engage the full depth of the gate rotor teeth for purposes of maintaining timing between the main rotor and gate rotor teeth in the chamber section of the device.

As the main rotor threads are interrupted, and in the present invention the main rotor is relieved between the chamber section and the driving section of said main rotor threads, it is possible to install main rotor thread baffling between said sections for purposes of improving the efficiency of the mechanism. Furthermore, by relieving the roots of the main rotor driving section threads, it is possible to shape the gate rotor tooth flanks at the tip of the gate rotor teeth to optimally conform to the thread flanks in the main rotor chamber section. The drive section thread root relief also allows one to form the radially inward portion of said gate rotor tooth flanks to best mesh with the drive portion of the threads, thus obtaining better efficiency in both sections of the mechanism. This results in optimum sealing of the chamber portion of the mechanism and requires no compromise in gate rotor tooth flank shape, thus promoting the efficiency of the mechanism. Consequently, that portion of the gate rotor teeth responsible for insuring a good mesh is not subject to wear in the chamber portion of the machine, nor is the chamber portion of the gate rotor tooth flank subject to wear in the drive portion of the machine.

BRIEF DESCRIPTION OF THE DRAWINGS

FIG. 6 is a cross-sectional view along line 6—6 of

DESCRIPTION OF THE PREFERRED EMBODIMENT

Figure 1:
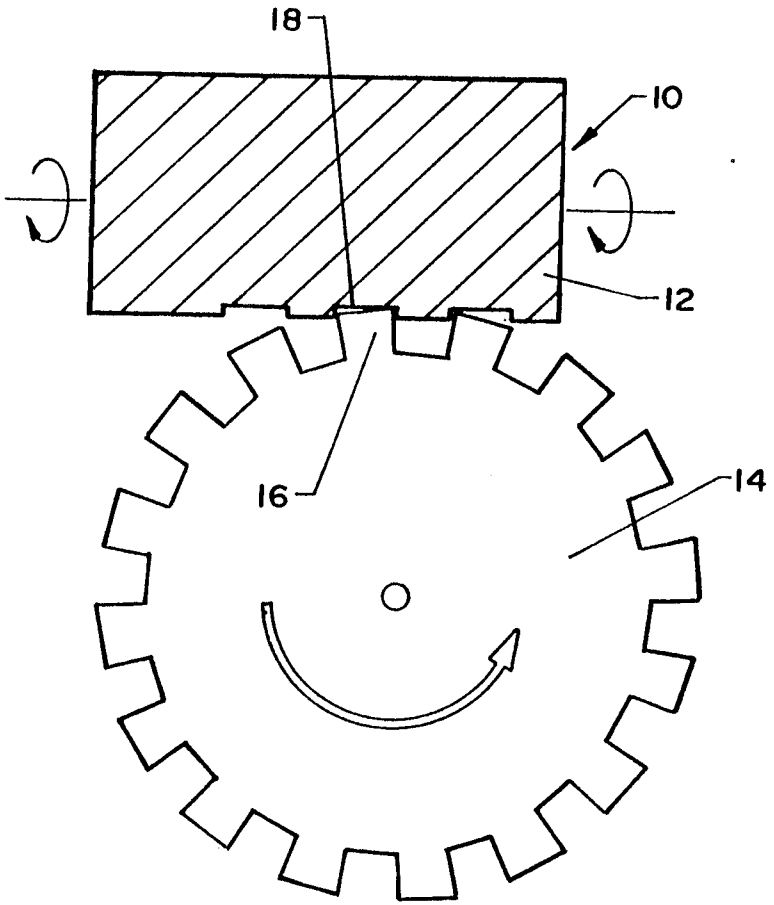
FIG. 1 is a schematic cross-sectional view of a main rotor and planar gate rotor showing shallow engagement of gate rotor teeth in the main rotor constructed according to prior art.

Referring now to the drawings wherein like referenced characters designate identical or corresponding parts, and more particularly to FIG. 1, there is shown schematically a prior art single screw mechanism, designated generally by the reference numeral 10, which is comprised basically of a main rotor 12 in shallow meshing engagement with a circular, planar gate rotor 14. As can be seen from FIG. 1, tooth 16 of gate rotor 14 is in shallow meshing engagement with thread 18 of main rotor 12, thus forming the chamber of the mechanism in cooperation with the mechanism casing (not shown). As can be seen from FIG. 1, when gate rotor tooth 16 is in shallow meshing engagement with thread 18 of main rotor 12, at any given time only one tooth of gate rotor 14, or at most a portion of two teeth, is in meshing engagement with main rotor 14. Since in prior art devices the timing between the main rotor and gate rotor is maintained by the meshing of gate rotor teeth with main rotor threads in the compression portion of the mechanism, shallow engagement, although desirable from the standpoint of machine efficiency, can create serious timing problems between the main rotor and gate rotor on account of the few number of teeth in engagement at any one time. Furthermore, such shallow engagement in prior art devices leads to high contact loads between the flanks of the gate rotor teeth and the main rotor threads, thus contributing significantly to machine wear and consequent loss of efficiency.

Figure 2:
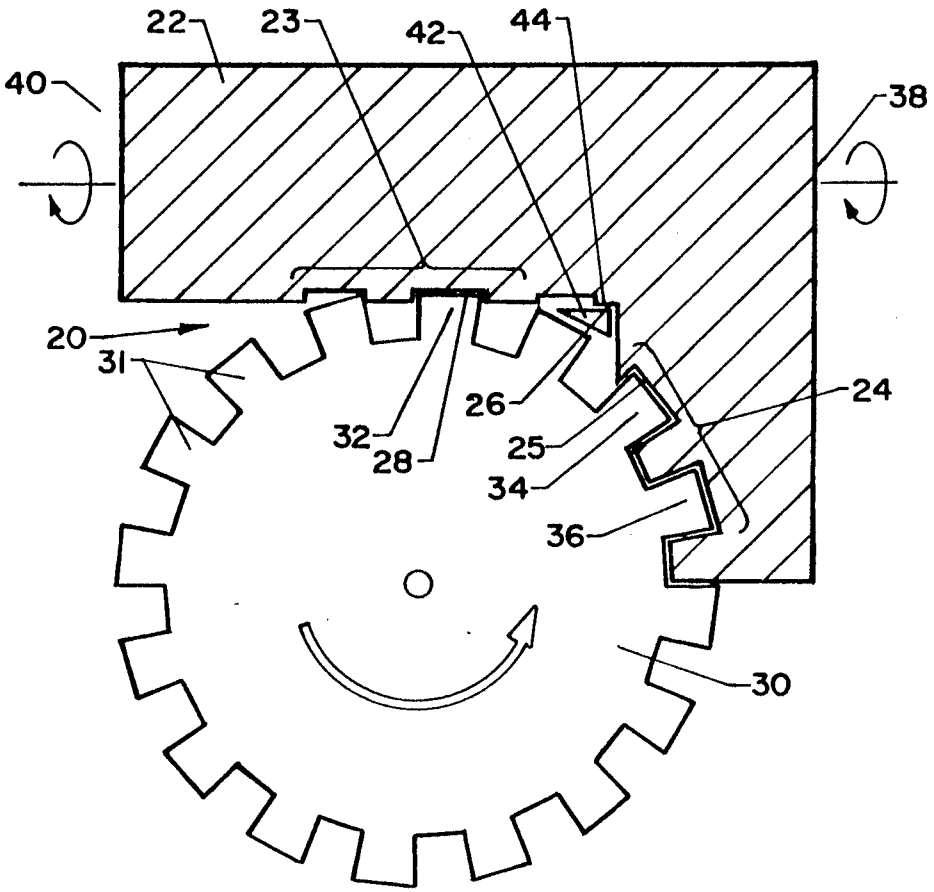
FIG. 2 is a schematic cross-sectional view of a device constructed according to the present invention with interrupted main rotor threads.
Figure 3:
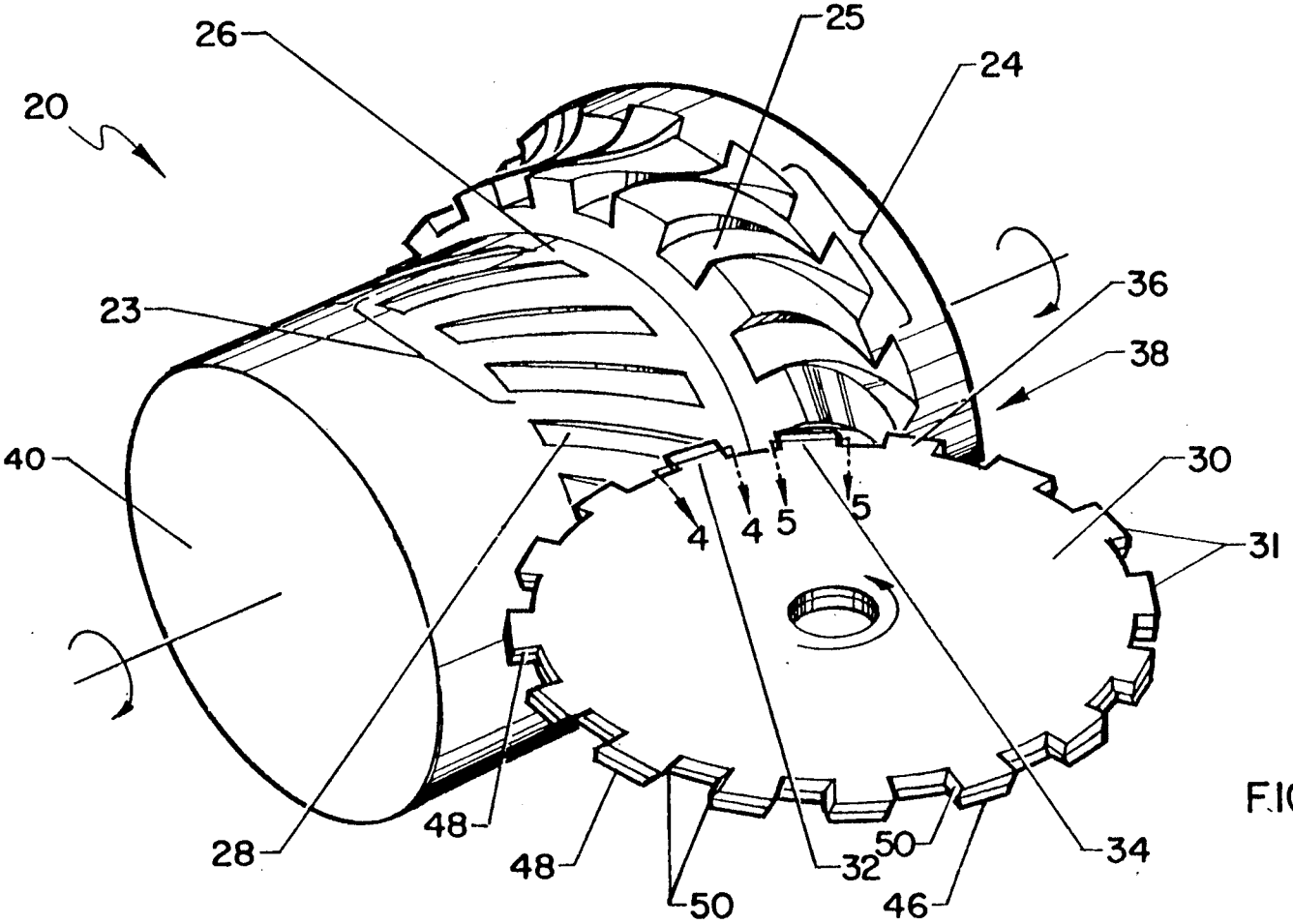
FIG. 3 is a three dimensional perspective view of an interrupted thread main rotor with planar gate rotor constructed according to the present invention.

In a device constructed according to the present invention these timing and wear disadvantages are eliminated by providing a device as shown schematically in FIG. 2 and in perspective view in FIG. 3 and designated generally by the reference numeral 20. This device is comprised basically of a main rotor 22 having a plurality of threads and a planar gate rotor 30 having a plurality of teeth, shown generally by the reference numeral 31, cooperating with a mechanism casing (not shown) to form a singe screw positive displacement mechanism having an inlet and an outlet and a chamber. As outlined above, the cooperation of main rotor thread 28, gate rotor tooth 32, and the casing operate to form the positive displacement chamber of mechanism 20. All components of the present invention may be constructed of steel, aluminum, composites or other suitable material.

Main rotor 22 has a chamber section of threads, shown generally by reference numeral 23, and a drive section of threads, shown generally by reference numeral 24, interrupted by a portion 26 of the main rotor 22 which is cut away, or relieved, to provide a space between the two sections of threads. If main rotor 22 were not cut away to provide a space 26 between sections 22 and 24, then each of the multiple threads disposed around main rotor 22 would be continuous. It should be noted that there are a plurality of main rotor threads, one of which is shown by the reference numeral 44, in chamber section 23, and one of which is shown by reference numeral 25 in drive section 24, disposed around main rotor 22. In the present invention it may be seen from FIG. 2 and 3 that gate rotor 30 has a plurality of gate rotor teeth, designated generally by the reference numeral 31, disposed entirely circumferentially therearound. At least one of its plurality of teeth, designated by the reference numeral 32, is in shallow meshing engagement with thread 24 of chamber section 23 of main rotor 22, while at the same time having multiple Sate rotor teeth , shown specifically by numerals 34 and 36, in full driving engagement with drive section 24 of main rotor 22.

It should be noted that main rotor 22 can be extended to include drive sections of main rotor threads on both the inlet and discharge ends of the single screw mechanism. However, as shown in FIGS. 2 and 3, it is generally preferable to locate the drive section 24 of the interrupted main rotor threads on the inlet side 38 of the single screw mechanism as opposed to the discharge side 40 as space at the discharge end is best used to seal against high-pressure driven leakage.

It is often times desirable to employ main rotor chamber section baffling 42 (see FIG. 2, not shown in FIG. 3) between the chamber section 23 and drive section 24 of the main rotor threads. Baffling 42 typically consists of an extension of the single screw mechanism case (not shown) to provide sealing across an additional chamber section thread crest 44 in order to minimize leakage between the inlet end of the single screw mechanism and the chamber.

Due to the high operating pressures of single screw positive displacement mechanisms constructed according to the present invention, it is often times desirable to reinforce gate rotor teeth against excessive deflection in order to minimize leakage and fatigue. As shown in FIG. 3, this may be accomplished by providing a gate rotor support 46 constructed of steel or other suitable material having reliefs 48 which allow clearance between main rotor compression threads 28, yet extend as closely as is practical to the flanks 50 and ends of the gate rotor teeth.

Figure 4:
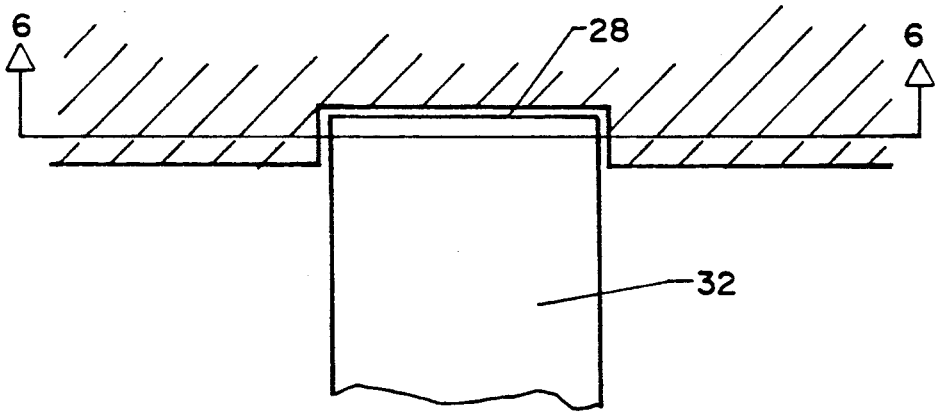
FIG. 4 is a cross-sectional view along line 4—4 of FIG. 3.
Figure 6:
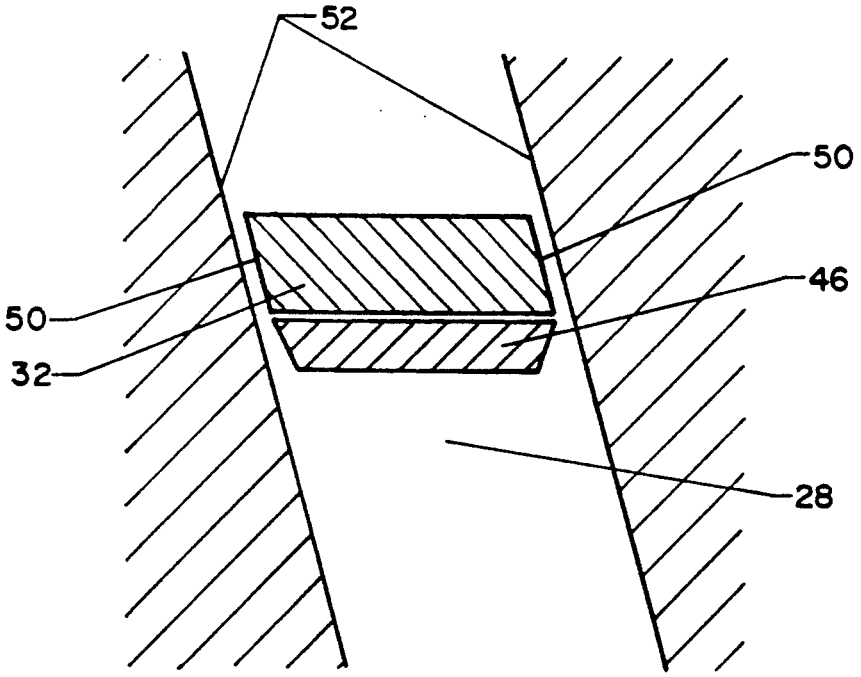

Referring now to FIG. 4 which is a sectional view along line 4—4 of FIG. 3, it can be seen that only the radially outward portion of gate rotor tooth 32 is in meshing engagement with main rotor chamber section thread 28. In order to reduce inefficiencies due to leakage, it is desirable that teeth 31 fit the physical configuration of thread 28 as closely as is possible, consistent with the sliding contact necessary to provide for the operation of the mechanism. This is shown in FIG. 6, a cross-sectional view taken along line 6-6 of FIG. g, wherein the radially outward flanks 50 of gate rotor tooth 32 are machined parallel to the flanks 52 of main rotor thread 28.

Figure 5:
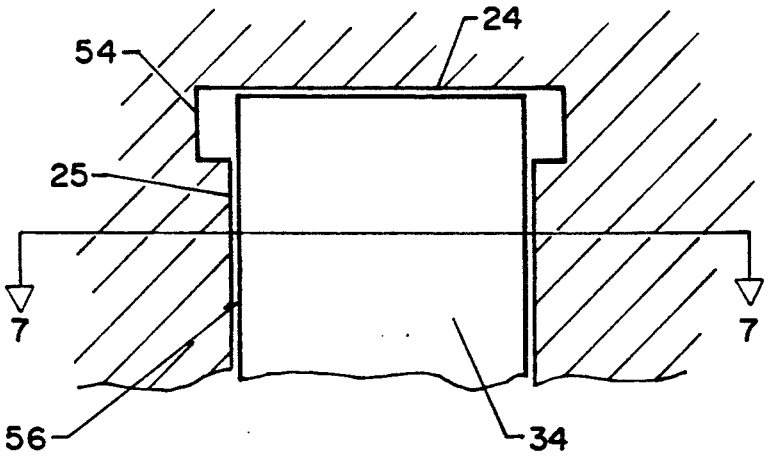
FIG. 5 is a cross-sectional view along line 5—5 of FIG. 3.

In prior art devices it has heretofore been necessary that the gate rotor tooth flanks have compromise flank angles in order to provide ample running clearance to both seal thread chambers as well as allow for the necessary gate rotor tooth penetration into the main rotor threads to provide good timing between the main rotor and gate rotor. Referring now to FIG. 5, which is a sectional view along line 5—5 of FIG. 3, in the present invention, and as may be seen from the above discussion, only the radially outward portion of gate rotor teeth 31 need to closely fit chamber section thread 28, and thus, it is possible to relieve the thread root portions 54 of the drive section main rotor threads 24. The use of drive section thread root reliefs 54 permit all of the forces necessary to drive gate rotor 30 to be exerted upon the radially inward flanks 56 of gate rotor teeth 31 and further allow ample clearance for the differing flank angles of the radially outward portion of gate rotor tooth 32 to pass through drive section threads 25.

Figure 7:
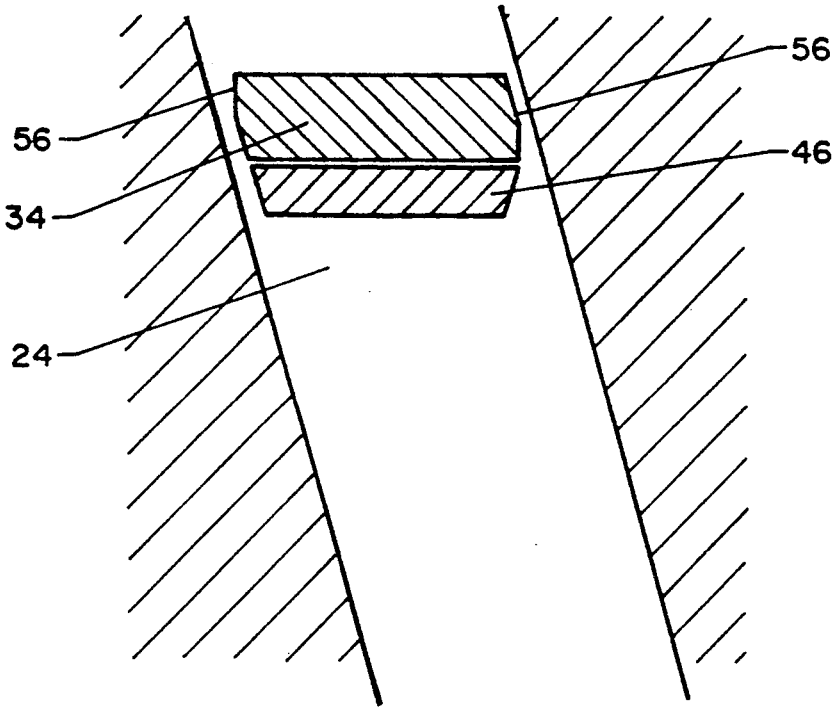
FIG. 7 is a cross-sectional view along line 7—7 of FIG. 5.

Referring now to FIG. 7, which is a sectional view taken along line 7—7 of FIG. 5, it may be seen that it is necessary to provide additional flank angle relief for the radially inward flank portion 56 of gate rotor tooth flanks 50 in order to assure ample working clearance with main rotor drive threads 24. However, because all of the driving forces of main rotor drive threads 24 are exerted against the radially inward flank portion 56 of gate rotor teeth 31, the flank angles of the radially outward portion of the gate rotor teeth need not be compromised and hence sealing efficiency is maintained between the outward portion of said teeth and main rotor threads 24 forming the mechanism chamber. This closer fit with chamber section threads 28 reduces leakage and thus improves the efficiency of the machine. Additionally, the engagement of gate rotor teeth 34 and 36 with main rotor driving section threads 24 insures proper timing between gate rotor 30 and main rotor 22 and results in lower wear rates between the gate rotor teeth 31 and both sections of main rotor threads. As hereinabove noted, a device constructed according to the present invention can be used in connection with main rotor thread baffling to enhance the overall efficiency of the mechanism.

It should be noted that the present invention can be practiced with many variations of materials, including the use of elastomeric or other sealing surfaces between the gate rotor teeth and main rotor threads, and that the components of the present invention may be constructed of any workable material. Obviously, numerous additional modifications of the present invention are possible in light of the above teachings. It is therefore to be understood that within the scope of the appended claims, the invention may be practiced otherwise than as specifically described herein.

What is claimed as new and desired to be secured by Letters Patent of the United States is:

1. A positive displacement singe screw mechanism an inlet and an outlet comprising:

a single main rotor having a plurality of interrupted threads, said interrupted threads comprising a relatively shallow chamber section of threads and a relatively deep driving section of threads at the inlet end of said mechanism;

a case cooperating with said main rotor to form one chamber with said chamber section of threads, said chamber being cyclically in fluid communication with the inlet and the outlet of said positive displacement single screw mechanism;

a gate rotor having at least one tooth in shallow meshing engagement with said chamber section of main rotor threads and simultaneously having at least one tooth in relatively deeper driving engagement with said driving section of main rotor threads, said tooth in engagement with said chamber section of threads cooperating with said thread section and said case to cyclically seal said chamber, and having gate rotor teeth flank relief angles of the radially outward portion of said gate rotor teeth in shallow meshing engagement with the chamber section of main rotor threads at the optimum angles to maximize the sealing engagement of said radially outward portion of said teeth with the chamber section of said main rotor threads, and further having gate rotor teeth flank relief angles of the radially inward portion of said teeth in driving engagement with the drive section of said main rotor threads at the optimum angles to facilitate the driving engagement of said radially inward portion of said teeth with the drive section of said main rotor;

a gate rotor support for supporting the teeth of said gate rotor from excessive deflection under operating loads;

baffling means located between said chamber section and said section of main rotor threads for additional sealing of said chamber section of the main rotor threads from the inlet of the mechanism; and relief cuts in the thread roots of said drive section of the main rotor threads such that only the radially inward flanks of said gate rotor teeth are drivingly engaged with said gate rotor drive of main rotor threads.

2. A positive displacement single screw mechanism an inlet and an outlet comprising:

a single main rotor means having a plurality of interrupted threads;

a case means cooperating with said main rotor means to form at least one chamber with one section of said interrupted threads of said main rotor means, said chamber being cyclically in fluid communication with the inlet and the outlet of said positive displacement single screw mechanism; and a gate rotor means having teeth in simultaneous meshing engagement with a portion of all sections of said interrupted threads extending around said main rotor means, said teeth cooperating with said case means and that section of said interrupted threads of said main rotor means forming said chamber to cyclically seal to said chamber.

3. A positive displacement single screw mechanism as in claim 2 further comprising:

a gate rotor support means for supporting the teeth of said Sate rotor means from excessive deflection under operating loads.

4. A positive displacement singe screw mechanism as in claim 2 wherein:

that portion of said interrupted threads cooperating with said case means and the teeth of said gate rotor means to form said chamber is shallow with respect to the remaining sections of said interrupted threads; and said gate rotor means has at least one tooth in shallow meshing engagement with said chamber section of said main rotor threads, and has multiple teeth in relatively deeper driving engagement with the remaining sections of said interrupted threads.

5. A positive displacement single screw mechanism as in claim 4 wherein:

said plurality of interrupted threads on said main rotor means comprise a first gate rotor drive thread section at the inlet end of said mechanism, a second gate rotor drive section at the outlet end of said mechanism, and a chamber section of threads located axially along said main rotor means between aforesaid inlet and outlet drive thread sections.

6. A positive displacement single screw mechanism as in claim 4 wherein:

said plurality of interrupted threads on said main rotor means comprises a gate rotor drive thread section at the inlet end of said mechanism and a chamber section of threads located axially along said main rotor means between the inlet and outlet ends of said mechanism.

7. A positive displacement single screw mechanism as in claim 6 further comprising:

baffling means located between said chamber section and said gate rotor drive section of threads for providing additional sealing of said chamber section of main rotor threads from the inlet of the mechanism.

8. A positive displacement single screw mechanism as in claim 7 wherein that section of interrupted main rotor means threads comprising the gate rotor drive section is relieved at the thread roots such that only the radially inward flanks of said gate rotor teeth are drivingly engaged with said gate-rotor drive section of main rotor threads.

9. A positive displacement singe screw mechanism as in claim 8 wherein:

the gate rotor teeth flank relief angles of the radially outward portion of said gate rotor teeth in shallow meshing engagement with the chamber section of main rotor threads are at the optimum angle to maximize the sealing engagement of said radially outward portion of said teeth with the chamber section of said main rotor threads; and wherein the gate rotor teeth flank angles of the radially inward portion of said gate rotor teeth in driving engagement with the gate rotor drive section of said main rotor threads are at the optimum angles to facilitate the driving engagement of said radially inward portion of said teeth with the Sate rotor drive section of said main rotor threads.

* * * * *